United States Patent [19]

Jacobs

[11] 4,279,367

[45] Jul. 21, 1981

[54] MUSICAL INSTRUMENT HARNESS

[76] Inventor: Michael E. Jacobs, 1147 Goettingen St., San Francisco, Calif. 94134

[21] Appl. No.: 52,169

[22] Filed: Jun. 26, 1979

[51] Int. Cl.[3] ..... A45F 5/00

[52] U.S. Cl. ..... 224/257; 224/258; 224/910; 84/327

[58] Field of Search ..... 224/258, 202, 257, 260, 224/264, 49, 910; 206/314; 150/2, 13, 14; 84/327, 280

[56] References Cited

U.S. PATENT DOCUMENTS

| | | | |
|---|---|---|---|
| 699,324 | 5/1902 | Holmes | 150/2 |
| 2,130,976 | 9/1938 | Stone | 150/2 |
| 2,643,039 | 6/1953 | Sottile | 224/5 |
| 2,915,233 | 12/1959 | Moomaw | 224/202 X |
| 3,037,416 | 6/1962 | Cunningham | 84/327 |
| 3,102,446 | 9/1963 | Raleigh | 224/910 X |
| 3,129,863 | 4/1964 | Haugen et al. | 224/258 |
| 3,833,751 | 9/1974 | Chapman | 84/1.16 |
| 3,884,403 | 5/1975 | Brewer | 224/257 X |
| 3,998,367 | 12/1976 | Harding | 224/1 A |

*Primary Examiner*—Steven M. Pollard

*Attorney, Agent, or Firm*—Townsend and Townsend

[57] ABSTRACT

A guitar harness that stabilizes the guitar in any of a wide range of desired positions. While the player may raise the guitar neck when desired, the instrument is prevented from assuming a position with the neck lower than a preset angular position. The harness utilizes first and second strap segments, each of which has means at its respective ends for attachment to first and second anchor points on the instrument. The first strap segment passes from the first anchor point diagonally upwardly across the back of the player and over the player's shoulder to the second anchor point in the manner of a conventional guitar strap. The second strap segment extends from the first anchor point, across the player's stomach (between the stomach and the guitar body), around the player's back, and then across the player's chest to the second anchor point. In the preferred embodiment, the harness comprises a single long strap having first and second fittings at opposite ends for attachment to the first anchor point, and a third fitting at an intermediate position on the strap to define the two strap segments, the third fitting being adapted to fasten to the second anchor point. A V-shaped buckle provides an improved self-locking and yet slidably adjustable mounting for holding the third fitting at the intermediate point on the strap.

10 Claims, 7 Drawing Figures

MUSICAL INSTRUMENT HARNESS

FIELD OF THE INVENTION

This invention relates generally to devices worn by a person for supporting objects in front of a user, and more particularly to strap arrangements for supporting musical instruments such as guitars.

BACKGROUND OF THE INVENTION

Many players of stringed instruments such as banjos and guitars perform in a standing position and thus require additional means for supporting the instrument in a playing position. Such an instrument is almost universally provided with paired spaced anchor points so that it may be supported by a strap or sling mounted between the anchor points and extending over the player's shoulder and across his back. For definiteness, the remainder of the specification will make explicit reference to guitars, but it should be understood that the present invention relates to other instruments as well.

Broadly, a guitar comprises a body and an elongate neck extending therefrom. The neck carries a fingerboard over a major portion thereof, and includes a heel portion at a first end where it joins the body and a head portion at a second end remote from the body. The strings extend along the elongate neck, and are fastened to suitable supporting structure on the body at one end and to a suitable tuning mechanism on the head portion. The first of the two anchor points is located on the body generally in line with the neck on the side of the body opposite that where the neck joins on. Depending on the instrument, and to some extent upon user preferences, the second of the two anchor points may be located on the instrument body generally proximate the heel, or at a position proximate the head.

Individual players typically have preferred locations of the instrument body and orientations of the instrument neck in which they find it most comfortable to play. For example, a relatively high position of the instrument body makes the playing of high notes easier and more relaxing to the player's wrist. On the other hand, a low position may be more comfortable in other respects. Similarly, the angular orientation of the neck is subject to a wide range of player preferences.

However, the traditional method of supporting a guitar presents certain disadvantages which render its use less than ideal. For example, the traditional strap support requires the player to provide additional support to the instrument neck and to make constant readjustments of the instrument orientation. This tends to put additional strain on the fretting hand, and can interfere with proper fretting technique. Depending on the degree of player movement, the problem of slippage can be relatively acute. When the guitar is worn relatively high on the user's body in order to facilitate the playing of high notes, or relatively low to gain comfort in other respects, a greater tendency of the neck to drop is experienced. A further problem, typically encountered with electric stringed instruments of the solid body variety, is that the relatively large weight of the instrument exerts considerable pressure on the player's shoulder near his neck and thus tends to promote fatigue.

In spite of the above mentioned disadvantages, the type of strap arrangement described above has found almost universal use among guitar players, and the problems of strain on the shoulders and the need to use the fretting hand in a support role have been accepted as unavoidable.

SUMMARY OF THE INVENTION

The present invention provides a guitar harness that stabilizes the guitar in any of a wide range of desired positions. While the player may raise the guitar neck when desired, the instrument is prevented from assuming a position with the neck lower than a preset angular position. Thus, the fretting hand is freed from its support role and rendered free for unhindered manipulation of musical expression. In addition, the player may completely release the neck with confidence that the guitar will remain in its preset position.

Broadly, a guitar harness according to the present invention utilizes first and second strap segments, each of which has means at its respective ends for attachment to the first and second anchor points on the instrument. The first strap segment passes from the first anchor point diagonally upwardly across the back of the player and over the player's shoulder to the second anchor point in the manner of a conventional guitar strap. The second strap segment extends from the first anchor point and wraps around the player's torso prior to having the other end fastened to the second anchor point. Preferably, this latter configuration is accomplished by having the second strap segment pass from the first anchor point across the player's stomach (between the stomach and the guitar body), around the player's back, and then across the player's chest to the second anchor point.

In the preferred embodiment, the harness comprises a single long strap having first and second fittings at opposite ends for attachment to the first anchor point, and a third fitting at an intermediate position on the strap to define the two strap segments, the third fitting being adapted to fasten to the second anchor point.

According to a further aspect of the present invention, an improved self-locking and yet slidably adjustable mounting for holding the third fitting at the intermediate point on a strap is utilized. The slidably adjustable locking member permits the user to set the third fitting at any desired intermediate point in order to achieve a desired instrument position. In the preferred embodiment, the third fitting is attached to a looped member through which the strap passes, and the slidably adjustable locking member is a V-shaped buckle. The buckle has mutually angled portions defining first and second spaced edges and a third common edge. Each angled portion has an elongate slot extending parallel to the edges and sized to accommodate the strap. The adjustable and self-locking feature is accomplished by threading the strap through the buckle slots and the looped member in a serial fashion as follows. The strap is passed through the first slot from the outside of the buckle, around the second edge and through the second slot also from the outside, across the "V" through the first slot from the inside, through the slotted member, again through the first slot from the outside, and across the "V" through the second slot from the inside.

A primary advantage of the present invention is that it maintains the guitar neck in any desired preset angular position over a broad angular range while still leaving the player freedom to raise the neck if desired. The present invention provides additional unexpected benefits in that the second strap segment, passing around the user's torso, puts some of the weight of the instrument on the player's hips, thus relieving his shoulder. Moreover, the player is rendered more sensitive to the proper use of the fretting hand, since excess downward pressure applied to the neck of the guitar makes the harness become slightly constricting to the torso of the user, thus providing instantaneous feedback of improper technique. Thus relaxed and correct playing is encouraged.

For a further understanding of the nature and advantages of the present invention, reference should be had to the remaining portions of the specification and the attached drawings.

DETAILED DESCRIPTION OF THE INVENTION

The present invention relates to supporting a musical instrument such as a guitar or banjo in front of a player so that the player may perform standing up without having to hold the instrument in position. For definiteness, the description that follows will be confined to a guitar. More specifically, a solid body electric bass guitar will be illustrated. However, it should be understood that the present invention is also suitable for other instruments.

Figure 1:
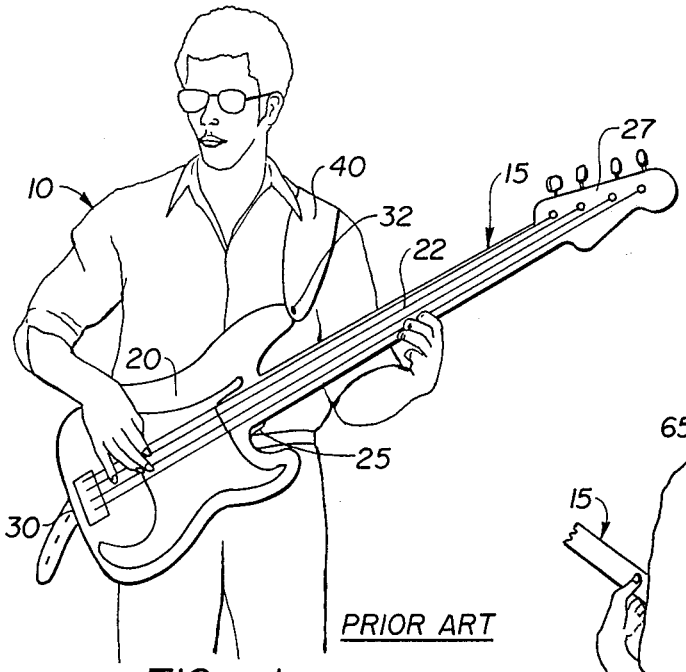
FIG. 1 is a perspective front view in pictorial form of a guitar player using a prior art conventional guitar strap.

FIG. 1 is a perspective front view of a player 10 performing on a guitar 15 which is supported in a conventional manner. Guitar 15 includes a body 20 and an elongate neck 22. Neck 22 joins onto body 20 at a heel portion 25, and terminates in a head portion 27 remote from body 20. Guitar 15 is provided with a first anchor point 30 in line with neck 22 and located on body 20 at a location remote from neck 22, and a second anchor point 32 on body 20 generally in the vicinity of heel 25. Anchor points 30 and 32 normally assume the form of an outwardly protruding pin or stud having a broadened head. Player 10 is shown playing a right-handed guitar, in a right-handed manner. Thus, neck 22 extends leftwardly from player 10, and fretting is carried out by the left hand. Guitar 15 is supported in a conventional prior art manner by a strap 40 attached to anchor points 30 and 32 and extending across the left shoulder of user 10.

Figure 2:
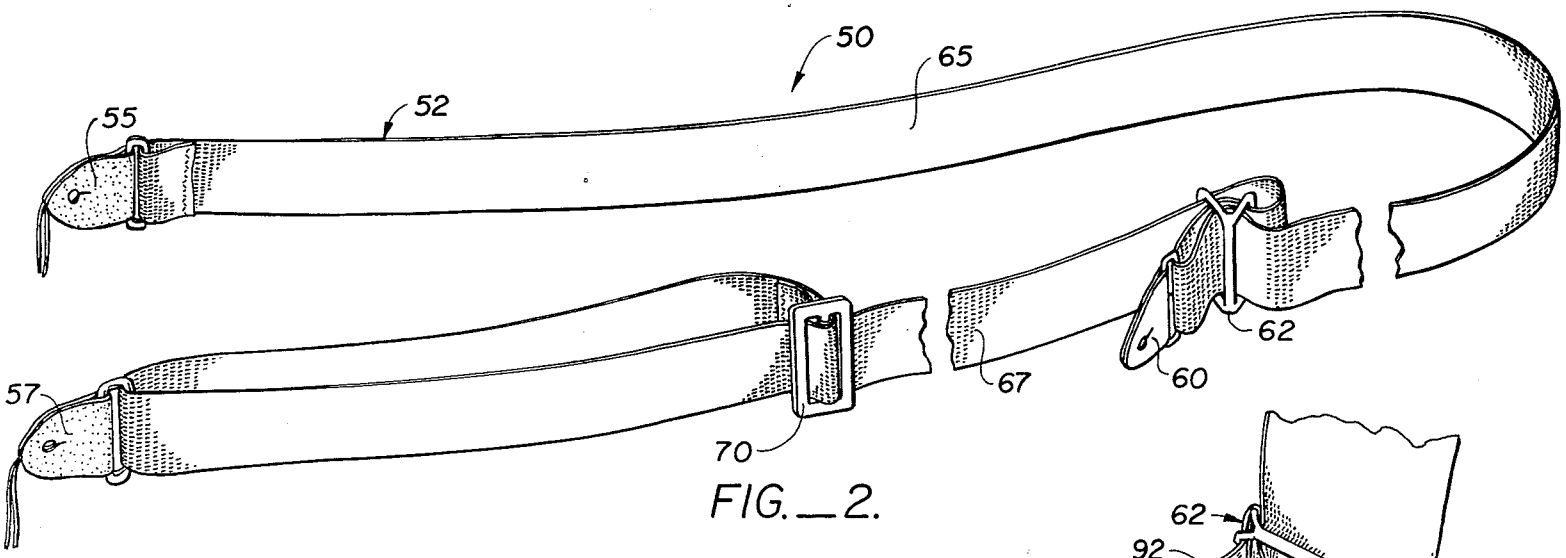
FIG. 2 is a perspective view of a guitar harness according to the present invention.

FIG. 2 is a perspective view of a guitar harness 50 according to the present invention. Guitar harness 50 includes an elongate strap 52 having first and second fittings 55 and 57 mounted at opposite ends thereof, fittings 55 and 57 being adapted to attach to anchor point 30. Harness 50 also comprises a third fitting 60 at an intermediate location on strap 52, and a slidably adjustable self-locking member 62 for maintaining third fitting 60 at an arbitrary preset position. Fitting 60 is adapted to attach to anchor point 32. Thus, the location of fitting 60 at an intermediate position on strap 52 defines first and second strap segments 65 and 67 on opposite sides of fitting 60. A conventional buckle 70 may be provided in order to allow for an overall length adjustment.

Strap 52 is fabricated from any suitable belting material of high strength such as belt inner facing material approximately three inches wide. In use, as will be described below, an overall length of approximately seven feet is required. Thus, belt 52 may be made to have an overall possible length in the neighborhood of nine feet to allow for extreme circumstances. Fittings 55, 57, and 60 are each formed from a sheet of suitable high-strength material such as leather and provided with a slotted aperture generally smaller than the maximum transverse dimension of the anchor point head. Attachment occurs in the manner of a button and buttonhole.

Figure 4:
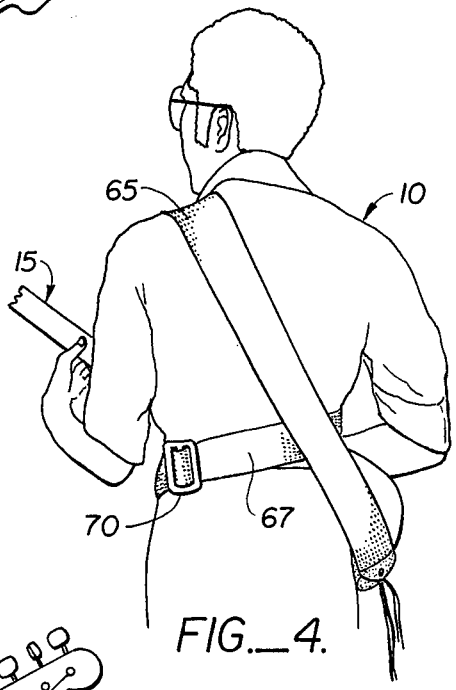
FIG. 4 is a perspective rear view in pictorial form of a player using a guitar harness according to the present invention.
Figure 5:
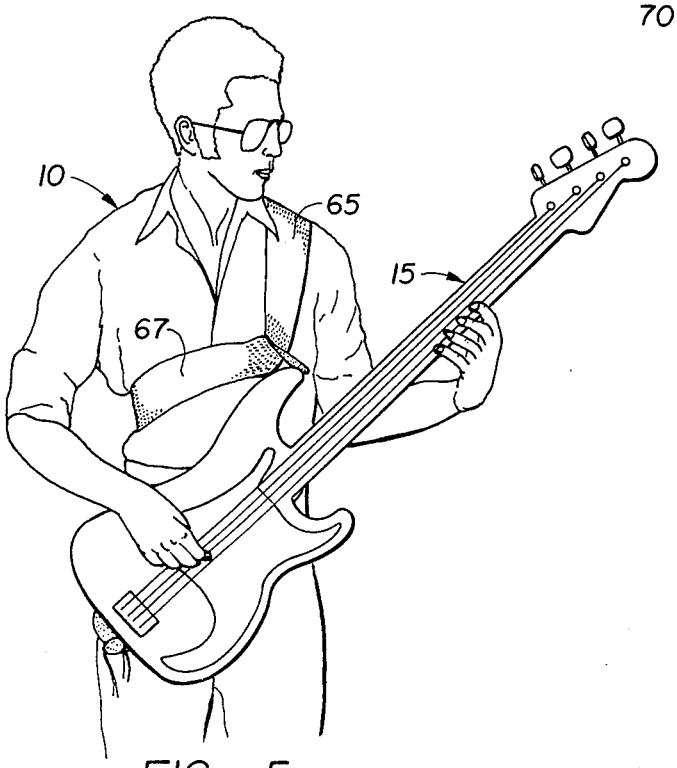
FIG. 5 is a perspective front view in pictorial form of a player using a guitar harness according to the present invention.
Figure 3:
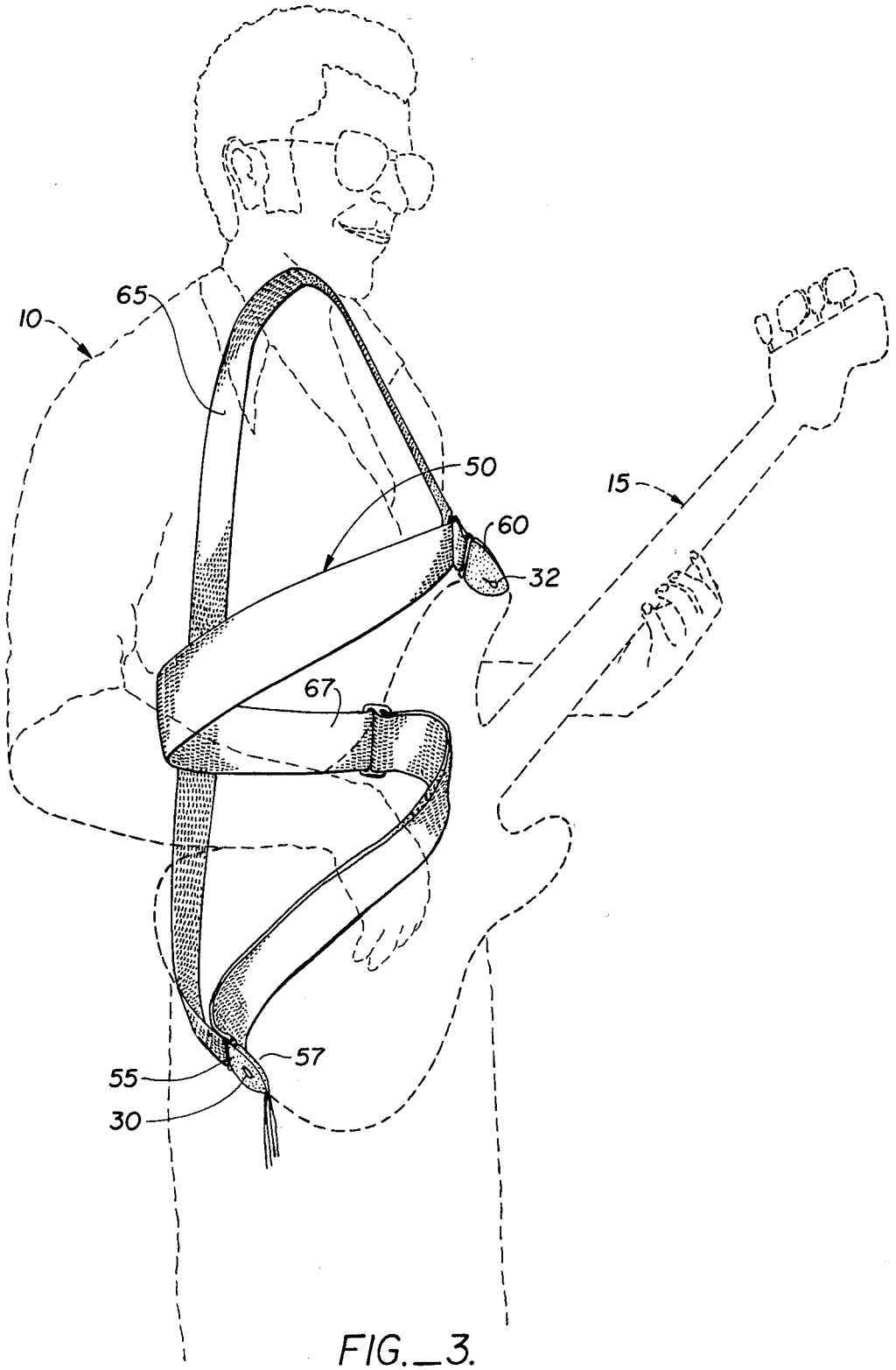
FIG. 3 is a perspective view showing the guitar harness in use, with the player and instrument shown in phantom.

The utilization of harness 50 may be seen with reference to FIGS. 3–5. FIG. 3 shows harness 50 on user 10 for supporting guitar 15, user 10 and guiter 15 being shown in phantom. In use, first strap segment 65 extends over the left shoulder of user 10 in the manner of conventional guitar strap 40 of FIG. 1. In particular, first fitting 55 is fastened to anchor point 30 and third fitting is fastened to anchor point 32. Second strap segment 67 is wrapped around the torso of player 10, second fitting 57 being attached to anchor point 30. Strap segment 67 extends from anchor point 30 across the stomach of player 10 (i.e. between the player's stomach and the back of guitar body 20), around the back and then across the user's chest whereupon it terminates at fitting 60 which is fastened to anchor point 32. The preferred sequence of putting harness 50 into use has player 10 put the harness on himself without the guitar, then fasten fittings 55 and 57 to anchor point 30, and finally attach fitting 60 to anchor point 32.

Figure 6A:
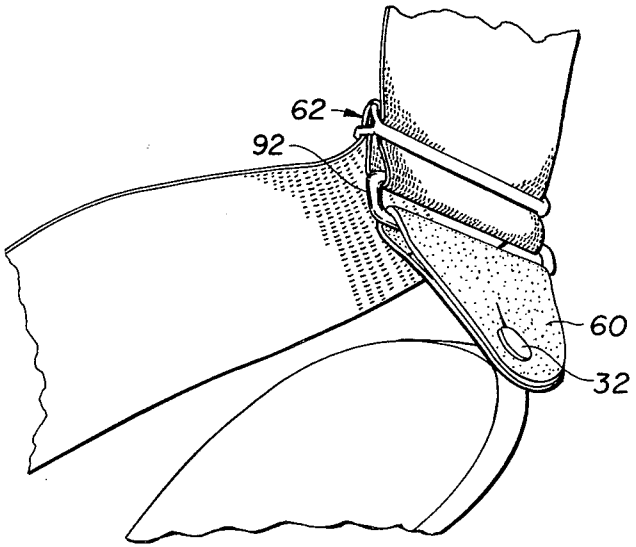
FIGS. 6*a* and 6*b* are detail views of the slidably adjusting self-locking mechanism for mounting the intermediate supporting member.
Figure 6B:
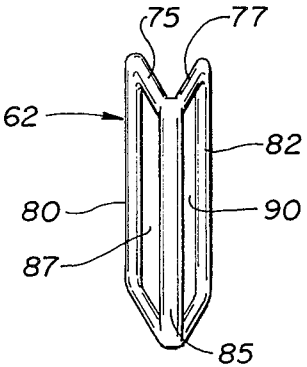

Thus it can be seen that the length of respective strap segments 65 and 67 is defined by the overall length of strap 52 and by the position of fitting 60. Fitting 60 is maintained in position by a slidably adjustable yet self-locking member 62 which, in the preferred embodiment, is fabricated in the form of a V-shaped buckle. Referring also to FIGS. 6A and 6B, buckle 62 includes mutually angled first and second members 75 and 77, members 75 and 77 defining respective outer edges 80 and 82 and a common edge 85. Buckle 62 is preferably a single rigid element, but it is also contemplated that angled portions 75 and 77 could be hingedly connected to one another along common edge 85. Angled members 75 and 77 are provided with respective elongate slots 87 and 90 sized to accommodate the width of strap 52. Third fitting 60 is carried on a looped element 92 which is sized to fit around strap 52.

The slidably adjustable and yet self-locking arrangement is achieved by a particular threading of strap 52 through slots 87 and 90. In particular, the strap passes through slot 87 from the outside of the buckle, around edge 82 and through slot 90 from the outside, across the space between members 75 and 77 to pass through slot 87 from the inside, through looped element 92, back through slot 87 from the outside, and across the space between elements 75 and 77 through slot 90 from the inside.

Once harness 50 is in position, first strap segment 65 supports the guitar generally in the normal fashion. However, strap segment 67 provides several surprising advantages which enable player 10 to play in a more relaxed and technically correct manner. In particular, strap segment 67 prevents neck 22 of guitar 15 from falling angularly lower than the preset position. The range of possible present positions typically comprehends an angular range of about 150°, allowing positions within approximately 15° of vertical (up or down), as well as the more nearly horizontal positions normally used. At the same time, player 10 is free to elevate the neck of the guitar should such be desirable. Additionally, strap segment 67 transmits some of the weight of the guitar to the player's hips, thus relieving the shoulder of some of the strain. Moreover, should player 10 inadvertently pull down on the guitar neck, a slight constriction caused by strap segment 67 around the user's torso will signal to the player that too much weight is being put on the neck. Thus, the fretting hand is freed from the need to support any of the weight of the guitar neck, and is left unhindered for proper fingering. Depending on the player's normal tendency to use the fretting hand in a supporting role, improved technique and a more relaxing playing experience result.

In summary, it can be seen that the present invention provides a guitar (or other musical instrument) harness that stabilizes the guitar in front of the player at any desired angular position. While the above description provides a full and complete disclosure of the preferred embodiment of the invention, various modifications, alternate constructions, and equivalents may be employed without departing from the true spirit and scope of the invention. For example, while a strap of uniform width has been shown, it will be appreciated that extra flexibility in the region of the intermediate fitting may be achieved by having a narrower portion of a strap at a central location. Therefore, the above description and illustrations should not be construed as limiting the scope of the invention, which is defined by the appended claims.

I claim:

1. A device for supporting and stabilizing an object in front of a user having a torso and at least one shoulder, the object having first and second spaced points of support comprising:

a first strap segment extending between said first and second points of support and sized to pass over said shoulder of said user;

a second strap segment extending between said first and second points of support and sized to wrap completely around said torso of said user;

each of said first and second strap segments having first and second ends;

first means for attaching said first ends of said first and second strap segments to said first point of support; and second means for attaching said second ends of said first and second strap segments to said second point of support;

said first and second strap segments together comprising a single strap, said first attaching means comprising first and second fittings at opposite ends of said strap, and said second attaching means comprising a third fitting at an intermediate position on said strap to define said strap segments;

said first and second fittings each being adapted to mate with said first point of support, and said third fitting being adapted to mate with said second point of support.

2. The invention of claim 1 also comprising a slidably adjustable locking member for maintaining said third fitting at an arbitrary preset position on said strap while allowing said user to adjust the location of said intermediate position.

3. A harness for supporting and stabilizing a musical instrument in front of a player, said musical instrument having first and second spaced anchor points, comprising:

a strap;

first and second fittings at opposite ends of said strap, said first and second fittings having means for attachment to said first anchor point;

a third fitting having means for attachment to said second anchor point; and mounting means for adjustably attaching said third fitting to said strap at an intermediate point thereof, said mounting means preventing said third fitting from sliding along said strap, said intermediate position on said strap defining first and second strap segments on either side of said intermediate position, said first strap segment being sized to pass over a shoulder of said player, said second strap segment being sized to pass around the torso of said player to stabilize said instrument with respect to rotation about a horizontal axis.

4. The invention of claim 3 wherein said mounting means comprises:

a looped member surrounding said strap, said third fitting being directly attached to said looped member;

means defining first and second slots, each slot being sized to permit said strap to pass therethrough in either of first and second opposite directions;

said strap passing serially through said first slot in said first direction, through said second slot in said first direction, through said first slot in said second direction, through said looped member, through said first slot in said first direction and through said second slot in said second direction to maintain said looped member in a slidably adjustable locked position.

5. The invention of claim 4 wherein said slot defining means comprises a V-shaped buckle having first and second mutually angled portions, said first and second slots being formed in said first and second angled portions, respectively.

6. A method for supporting and stabilizing a musical instrument in front of a player, said musical instrument being of the type having first and second spaced anchor points, comprising the steps of:

fastening a first strap segment between said first and second anchor points;

extending said first strap segment across a shoulder of said player;

wrapping a second strap segment across the stomach, around the back, and across the chest of said player to form a complete loop around the torso of said player; and fastening said second strap segment between said first and second anchor points.

7. The method of claim 6 wherein said step of wrapping said second strap segment occurs before said step of fastening said second strap segment.

8. A harness for supporting and stabilizing a musical instrument in front of a player, said musical instrument having first and second spaced anchor points, comprising:

a first strap segment extending between said first and second anchor points and sized to pass over a shoulder of said player;

a second strap segment extending between said first and second anchor points and sized to pass across the stomach, around the back, and across the chest of the player;

each of said first and second strap segments having first and second ends;

first means for attaching said first ends of said first and second strap segments to said first anchor point; and second means for attaching said second ends of said first and second strap segments to said second anchor point.

9. The invention of claim 8 wherein said first and second strap segments together comprise a single strap, wherein said first attaching means comprises first and second fittings at opposite ends of said strap, and wherein said second attaching means comprises a third fitting at an intermediate position on said strap to define said strap segments, said first and second fittings each being adapted to mate with said first anchor point, and said third fitting being adapted to mate with said second anchor point.

10. The invention of claim 9 also comprising a slidably adjustable locking member for maintaining said third fitting at an arbitrary preset position on said strap to allow said player to adjust and maintain the location of said intermediate position.

* * * * *